US006378581B1

(12) United States Patent
Sheridan et al.

(10) Patent No.: US 6,378,581 B1
(45) Date of Patent: Apr. 30, 2002

(54) HOLLOW CAGE GOLF BAG COVER

(76) Inventors: Thomas Leonard Sheridan, 18161 Daves Ave., Monte Sereno, CA (US) 95030; Michael Joseph Sheridan, 13812 Serra Oaks Ct., Saratoga, CA (US) 95070; William Francis Sheridan, 4348 Silva Ct., Palo Alto, CA (US) 94306

( * ) Notice: Subject to any disclaimer, the term of this patent is extended or adjusted under 35 U.S.C. 154(b) by 0 days.

(21) Appl. No.: 09/698,649

(22) Filed: Oct. 30, 2000

(51) Int. Cl.[7] ..... A63B 55/00
(52) U.S. Cl. ..... 150/159; 206/315.4
(58) Field of Search ..... 150/159, 160; 206/315.2, 315.3, 315.4

(56) References Cited

U.S. PATENT DOCUMENTS

| | | | | | |
|---|---|---|---|---|---|
| 1,375,397 | A | * | 4/1921 | Lawrence | 220/9.3 X |
| 1,570,510 | A | * | 1/1926 | McQuirk | 206/315.4 |
| 1,691,904 | A | * | 10/1928 | Gamble | 220/9.3 X |
| 2,705,039 | A | * | 3/1955 | Halter | 150/160 |
| 3,014,516 | A | * | 12/1961 | Mueller | 220/9.3 X |
| 3,913,648 | A | * | 10/1975 | Sessler | 150/159 X |
| 3,985,171 | A | | 10/1976 | Summers et al. | |
| 4,200,133 | A | | 4/1980 | Whitlow | |
| 4,234,025 | A | | 11/1980 | Berge | |
| 4,442,937 | A | | 4/1984 | Delauder | |
| 4,453,632 | A | | 6/1984 | Clower | |
| 4,498,579 | A | * | 2/1985 | Brick | 206/315.4 |
| 4,752,004 | A | | 6/1988 | Very | |
| 4,815,784 | A | | 3/1989 | Zheng | |
| 4,979,548 | A | * | 12/1990 | Howard, III et al. | 150/159 |
| 5,005,623 | A | | 4/1991 | Webster | |
| 5,024,259 | A | | 6/1991 | Treadway | |
| 5,024,262 | A | | 6/1991 | Huang | |
| 5,131,442 | A | * | 7/1992 | Bevier | 150/159 |
| 5,220,950 | A | * | 6/1993 | Cordasco | 150/159 |
| 5,226,464 | A | * | 7/1993 | Solov | 150/159 |
| 5,383,505 | A | * | 1/1995 | Cordasco, Jr. | 150/159 |
| 5,437,320 | A | * | 8/1995 | Sung | 150/160 |
| 5,560,485 | A | * | 10/1996 | O'Hara, Jr. | 206/315.4 |
| 5,762,188 | A | * | 6/1998 | Nishimura | 206/315.4 |
| 5,779,042 | A | * | 7/1998 | Kaneko | 206/315.4 |
| 6,148,999 | A | * | 11/2000 | Olson | 206/315.4 |

OTHER PUBLICATIONS

DriStix Raincover—Advertised in "Player, The Magazine of the Golf Society of the U.S" on p. 17 Sep./Oct. 2000 Edition.

* cited by examiner

*Primary Examiner*—Lee Young
*Assistant Examiner*—Tri M. Mai

(57) ABSTRACT

A golf bag comprising a body and a cover is disclosed. The cover protects the open end of the golf bag body during inclement weather conditions keeping the clubs contained within the golf bag body from getting wet. The cover is small in size and can be easily stowed in a pocket of the golf bag body. It can be quickly retrieved, deployed and attached to the open end of the golf bag body when weather conditions demand. When in the deployed state attached to the golf bag body, the cover provides a large, hollow space cage around the golf clubs, providing full visibility with no materials draping over or obscuring the golf clubs. The top end of the cover is designed to open and close which allows full access to the clubs enabling easy removal and replacement through an opening equal to or greater in size than the opening in the golf bag body itself.

12 Claims, 5 Drawing Sheets

HOLLOW CAGE GOLF BAG COVER

FIELD OF THE INVENTION

This invention relates to golf bag covers used to protect golf clubs during rain and other wet weather conditions.

BACKGROUND OF THE INVENTION

Golfers enjoy playing golf in almost any kind of weather, often encountering rain or other inclement conditions during a game. If they decide to finish a game in spite of bad weather, it would be advantageous to provide some sort of protection for their golf clubs, otherwise the club handles get wet and slippery, making the clubs bard to hold and control. In addition, the clubs themselves may be damaged. It is, therefore, very desirable for golfers to have an emergency cover stowed in their golf bag that can be retrieved and placed over the end of the golf bag to protect the clubs and keep them dry in the event of sudden bad weather.

There are many golf bag covers presently on the market intended to help the golfer in bad weather. However, all of these covers lack one or more desirable features. U.S. Pat. No. 3,985,171 to Summers et al. and U.S. Pat. No. 4,442,937 to Delauder offer designs that are rigid body enclosures providing protection for the golf clubs when the covers are closed and good visibility of the clubs when the covers are open, but their rigid design does not let them be easily stowed in the golf bag. U.S. Pat. No. 5,005,623 to Webster, Jr., U.S. Pat. No. 5,131,442 to Bevier, U.S. Pat. No. 5,024,259 to Treadway, U.S. Pat. No. 4,752,004 to Very, U.S. Pat. No. 4,453,632 to Clower, U.S. Pat. No. 4,200,133 to Whitlow, and U.S. Pat. No. 4,234,025 to Berge all offer designs made of flexible materials that offer varying stowage capabilities and some of the covers are made of transparent materials that offer a degree of club visibility, but all of these designs allow the material of which the cover is made to drape over and sometimes even cling to the clubs themselves. This reduces club visibility and makes removing and replacing them difficult. It would be much more desirable if the cover provided a fixed open space around the clubs precluding the possibility of material draping over or clinging to them, and a top that, when open, exposed the entire end of the clubs, but that would also allow easy stowage in the golf bag. It is apparent, therefore, that a better golf bag cover that provides all the desirable features is needed.

SUMMARY OF THE INVENTION

A golf bag comprising a body and a cover is disclosed. The cover protects the open end of the golf bag body during inclement weather conditions keeping the clubs contained within the golf bag body from getting wet. The cover is small in size and can be easily stowed in a pocket of the golf bag body. It can be quickly retrieved, deployed and attached to the open end of the golf bag body when weather conditions demand. When in the deployed state attached to the golf bag body, the cover provides a large, hollow space cage around the golf clubs, providing full visibility with no materials draping over or obscuring the golf clubs. The top end of the cover is designed to open and close which allows full access to the clubs enabling easy removal and replacement through an opening equal to or greater in size than the opening in the golf bag body itself.

In one embodiment, the cover comprises a tubular section that has a diameter that will loosely fit over the open end of a golf bag body. It is made using a thin, clear plastic material. At least one foldable circular spring loop made of a thin gauged spring wire or other spring material is attached to the inside of the tubular section which forces the wall of the tubular section to expand outward to form a hollow cylinder or cage that encloses the golf clubs. An adjustable cord is placed around the circumference of the cylinder in the area where it slips over the golf bag that can be adjusted to make the cylinder conform and cling to the contour of the golf bag. In one embodiment, no foldable circular spring loops arc placed in this juncture area. In one embodiment the cylinder is made a sufficient height so that it is long enough to cover a longest golf club contained in the golf bag. The end of the cylinder opposite the golf bag juncture end is left open. A second cylinder, utilizing the same fabrication techniques as used for the first cylinder, namely the thin material and at least one foldable circular spring loop, is made to form a top to fit over the first cylinder. In one embodiment, the top is fixed to the first cylinder using a hinge so that the top can be opened and closed. Suitable materials are attached between the top and the cylinder so that a latching function fastening the top to the cylinder can be achieved when desired.

In one embodiment, the cover is prepared for stowage by closing the top and detaching the cover from the golf bag. The cover is then compressed using a downward pressure until the cylinder is flattened like an accordion. The result is a relatively thin, circular disk shape with the foldable circular spring loops forming the outer circumference. The right side of the foldable circular spring loops is then grasped with the right hand and the left side of the foldable circular spring loops is grasped with the left hand. All the foldable circular spring loops are then twisted in unison by rotating the right hand in a clockwise direction 90 degrees and the left band in a counterclockwise direction 90 degrees. The result is a shape that resembles a figure eight. The right half of the figure eight shape is then folded over the left half of the figure eight shape, resulting in a circular shape about one half the size of the original foldable circular spring loops. The folded cover is retained in this shape by using an elastic or rubber band or similar restraining device. The cover is now ready for stowage in the golf bag, its size being approximately one half the diameter of the original spring loops and being almost flat. In this state the cover requires very little space for stowage in the golf bag.

The cover may be deployed when needed by removing the restraining device, thus allowing the cover to immediately spring into its full size, forming the large, hollow space cage that will enclose the golf clubs. The deployed cover can then be slipped over the open end of a golf bag and secured in place by tightening the adjustable cord.

It can be readily seen that the cover overcomes the objectionable features of the prior art through the simple use of one or more foldable circular spring loops attached to tubular sections. The golf bag cover has a large, hollow space cage that allows unobstructed visibility of all of the golf clubs, with no material draping over them, plus a top that can be easily opened and closed. The golf bag cover can be folded into a small size for stowage when not needed. The transition from stowage to full use is simple and quick to accomplish. The golf bag cover can be attached to the golf bag body without the use of mechanical snaps or other such devices. The above and other features of the invention will be more fully understood from the following detailed description and the accompanying drawings, in which:

DETAILED DESCRIPTION OF EMBODIMENTS OF THE PRESENT INVENTION

Figure 1:
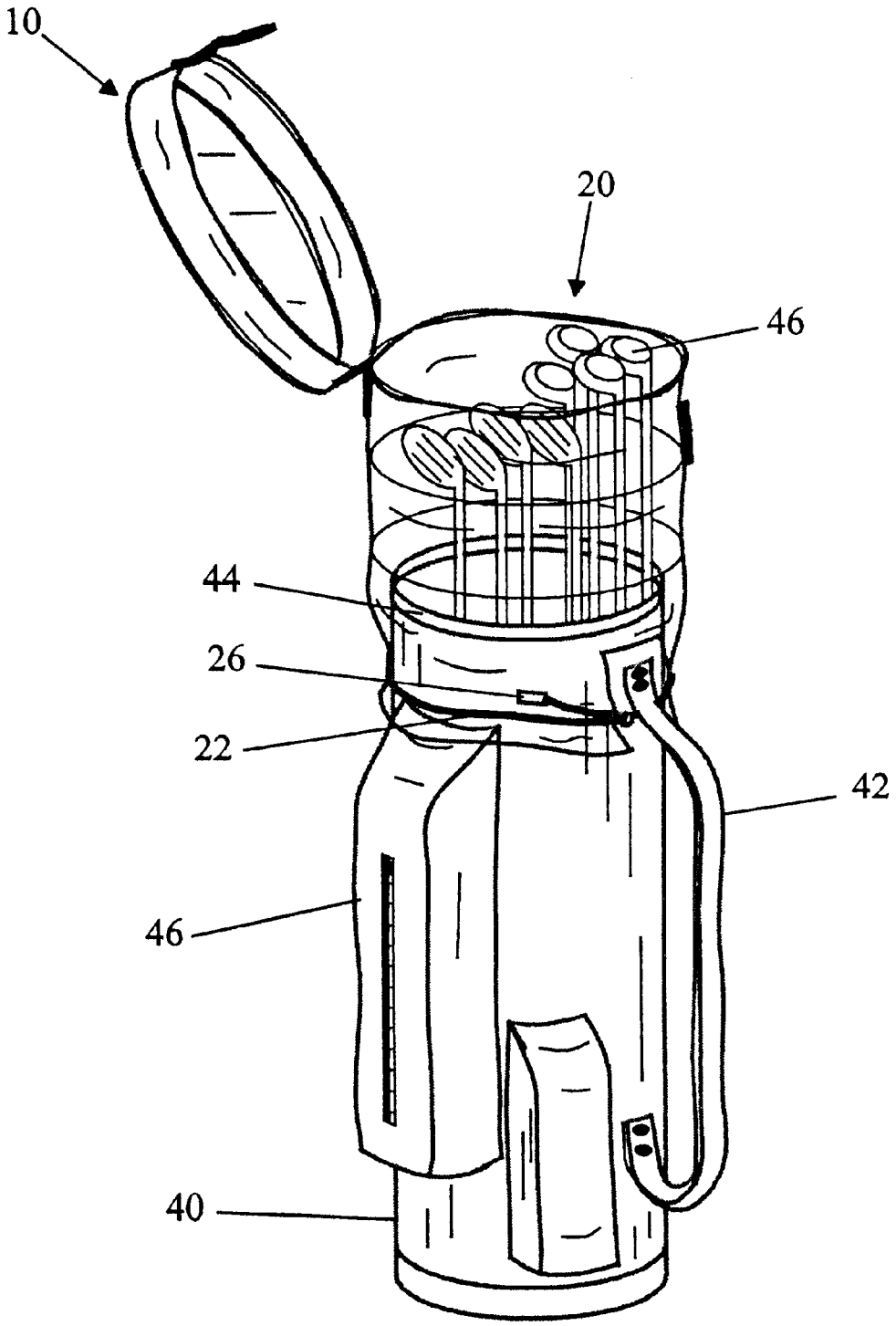
FIG. 1 is a perspective view of one embodiment of a golf bag cover mounted on a golf bag.
Figure 2:
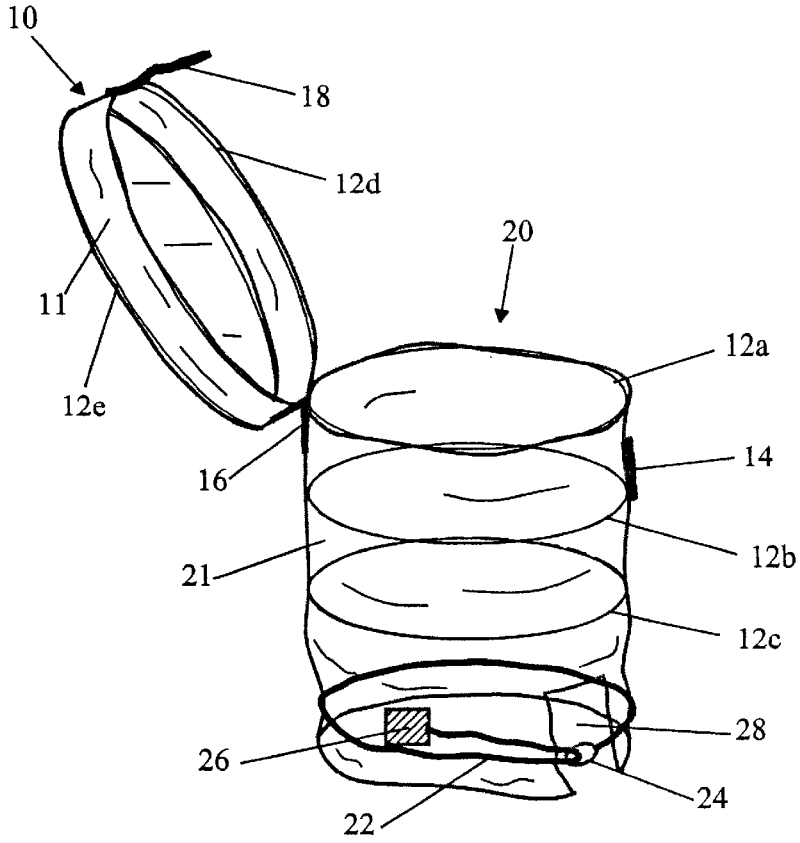
FIG. 2 is a side illustration view of one embodiment of a golf bag cover with the top open.

With reference to FIG. 1 and FIG. 2, one embodiment of a golf bag cover comprises a cylindrical body 20 and a top 10. In one embodiment, a wall 21 of the cylindrical body 20 is made of a thin, clear plastic or similar material. In one embodiment, the wall 21 is about 0.0015 inch thick. The use of a clear material is functionally useful to provide visibility of the golf clubs inside the golf bag in practice. It will be apparent to one schooled in the art that an opaque plastic, a cloth, canvas, paper or any other like material can be easily substituted for the clear plastic if desired cylindrical body 20 is made with two open ends and a diameter that will loosely fit over a neck 44 of a typical golf bag 40. The wall 21 can optionally be made using one layer of material or with two layers of material, one being placed over the other. Three circular spring loops 12*a*, 12*b* and 12*c*, each made of a small gauge spring steel wire, typically #11 gauge wire, or some similar material, are attached to wall material 21. The spring loops 12*a*, 12*b* and 12*c* can be attached to a single layer wall 21 by using glued or sewed tape to encase the spring loops, or some other suitable mechanism, or spring loops 12*a*, 12*b* and 12*c* can be attached to a two layer wall 21 by sandwiching spring loops 12*a*, 12*b* and 12*c* in between the two layers and bonding the two layers together using a heat seaming method, commonly used in bonding thin plastics, or by sewing or using some other suitable bonding method, to form channels around the circumference of the cylindrical body 20 encasing the spring loops 12*a*, 12*b* and 12*c* in the channels. A cord 22 made of a thin, flexible material is attached to wall 21 using one of the same methods described above for attaching spring loops 12*a*, 12*b* and 12*c* to wall 21. A ring 24 is attached to one end of cord 22. A hooks side Velcro piece 26 is attached to the other end of cord 22. The hooks side Velcro piece 26 is made a size that will pass through the opening in ring 24. A cutout 28 is made in wall 21 to accommodate the upper end of handle 42 attached to golf bag 40. Before mounting cylindrical body 20 onto golf bag 40, hooks side Velcro piece 26 is pulled back through ring 24 causing the loop of cord 22 to become disconnected. After cylindrical body 20 is mounted on golf bag 40, hooks side Velcro piece 26 is passed under handle 42 and subsequently back through ring 24 in a direction that causes cord 22 to make a loop around golf bag 40 and tighten so as to crush wall 21 against golf bag 40 causing wall 21 to conform to the contour of the neck 44 of golf bag 40. Hooks side Velcro piece 26 is then attached to a loops side Velcro piece (not shown) that is attached to wall 21 in an appropriate location to keep cord 22 in a tightened condition. Multiple loops side Velcro pieces (not shown) can be placed at strategic locations around the circumference of wall 21 so that cord 22 can be made varying lengths to accommodate various neck 44 sizes for various golf bag 40 sizes. In one embodiment, the height of cylindrical body 20 is chosen such that cylindrical body 20 reaches above a tallest golf club 46 contained in golf bag 40. Top 10 is made using the same materials and techniques that were employed to make cylindrical body 20. The uppermost end of top 10 is closed using the same material as used to make wall 11 and the lowermost end of top 10 is made open. Circular spring loops 12*d* and 12*e* are made a diameter slightly larger than circular spring loops 12*a*, 12*b* and 12*c* and are attached to wall 11. A hinge 16, made of a thin flexible material in one embodiment, attaches top 10 to cylindrical body 20. A Velcro hooks piece 18 is attached to wall 11 and a Velcro loops piece 14 is attached to wall 21 such that, as best seen in FIG. 3, when top 10 is closed over cylindrical body 20, Velcro hooks piece 18 contacts Velcro loops piece 14 and causes top 10 to be latched down to cylindrical body 20.

Figure 3:
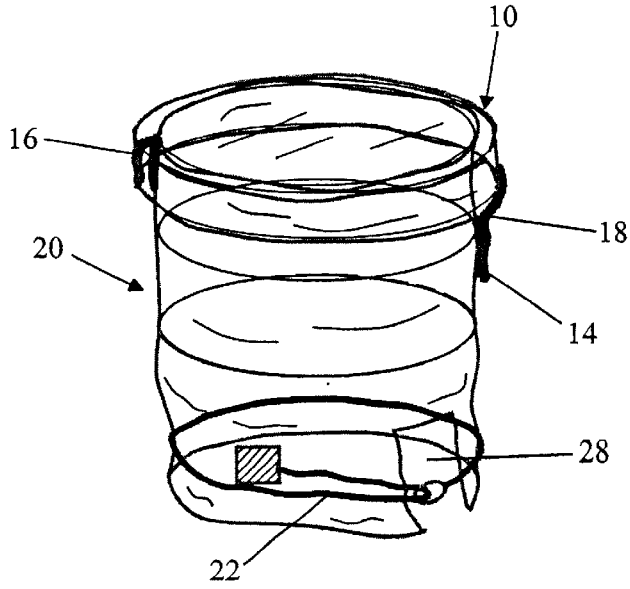
FIG. 3 is a side illustration view of one embodiment of a golf bag cover with the top closed.
Figure 4:
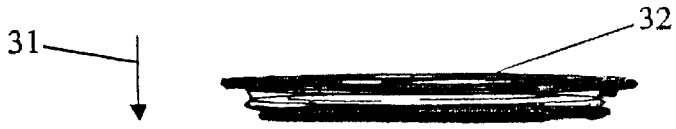
FIG. 4 is a side illustration view of the FIG. 3 view of a cover compressed in the direction of the arrow to a flattened state in preparation for stowing.
Figure 5A:
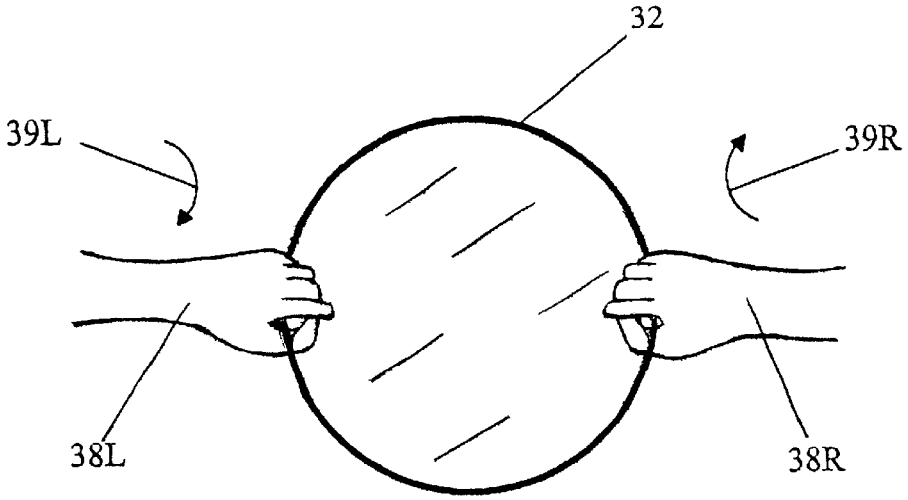
FIGS. 5*a*, 5*b* and 5*c* is a plan view showing one method used to fold the cover into the shape used for stowing the cover in the golf bag.
Figure 5C:
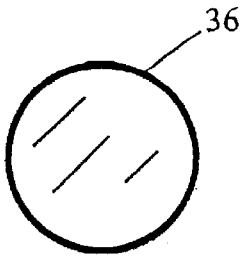
Figure 5B:
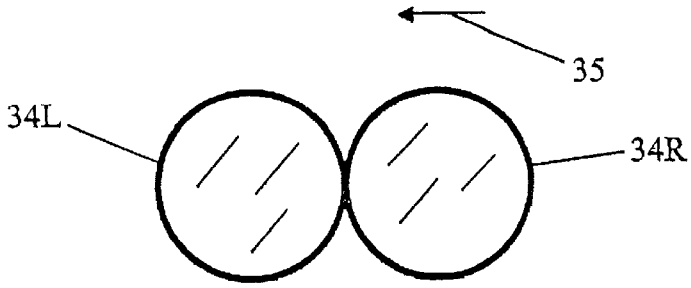

Referring to FIG. 3 and FIG. 4, in order to fold the golf bag cover into a reduced size for stowage, top 10 and cylindrical body 20 are first compressed using a downward force in the direction of arrow 31 to form a compressed disk 32. FIG. 5*a* is a top view illustration of compressed disk 32. Right hand 38R is used to grasp compressed disk 32 on the right side and left hand 38L is used to grasp compressed disk 32 on the left side. Right hand 38R is then rotated 90 degrees clockwise in the direction of arrow 39R and left hand 38L is rotated 90 degrees counterclockwise in the direction of arrow 39L causing compressed disk 32 to transform to make right shape 34R and left shape 34L as shown in FIG. 5*b*. Right shape 34R is then folded back over left shape 34L in the to direction of arrow 35 causing compressed disk 32 to become the reduced size disk 36 as shown in FIG. 5*c*. Reduced size disk 36 is then maintained in this reduced shape by wrapping it with an elastic or rubber band or other restraining device (now shown). Compressed disk 32 is thus reduced to approximately one half of its original diameter forming reduced size disk 36 which can be easily and conveniently stowed in a pocket 46 of golf bag 40.

Figure 6:
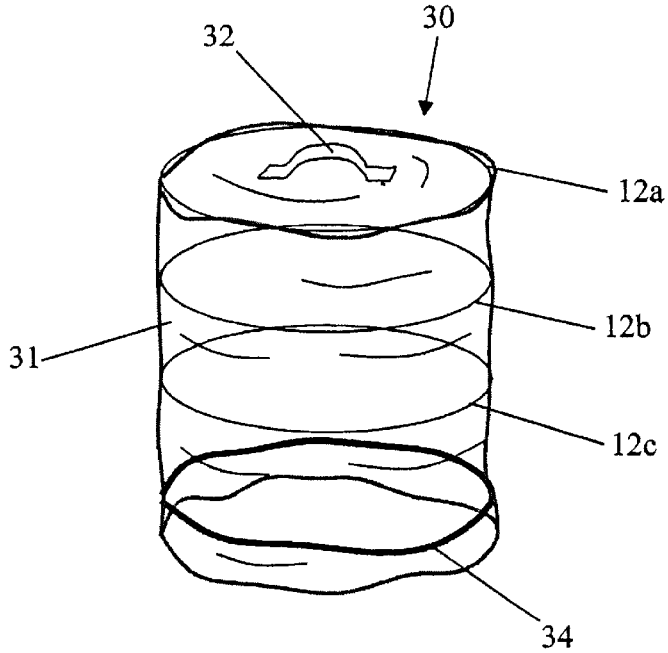
FIG. 6 is a side illustration of a second embodiment of the cover.

FIG. 6 shows another embodiment of the golf bag cover. Cover 30 is made using methods and materials substantially similar to those used to make cylindrical body 20 with the following exceptions. The end opposite the end that mounts on neck 44 of golf bag 40 is made closed using the same material as used to make wall 31. Circular spring loops 12*a*, 12*b* and 12*c* are attached to wall 31. A handle 32 is attached to the closed end of cover 30. A band 34 made of elastic or similar material is placed proximal to the area of the juncture of cover 30 and neck 44 to make wall 31 fit snugly to the contour of neck 44 when cover 30 is attached to golf bag 40 at neck 44. In operation, cover 30 is attached to golf bag 40 by expanding band 34 to fit over neck 44 and sliding cover 30 into place. To take out and replace golf clubs from golf bag 40, cover 30 is removed by pulling cover 30 in an upward direction using handle 32. After club use, cover 30 is replaced on golf bag 40. Cover 30 is prepared for stowing, stowed and deployed for use in the same manner as the top 10 and cylindrical body 20 combined cover previously described in the first embodiment.

Figure 7:
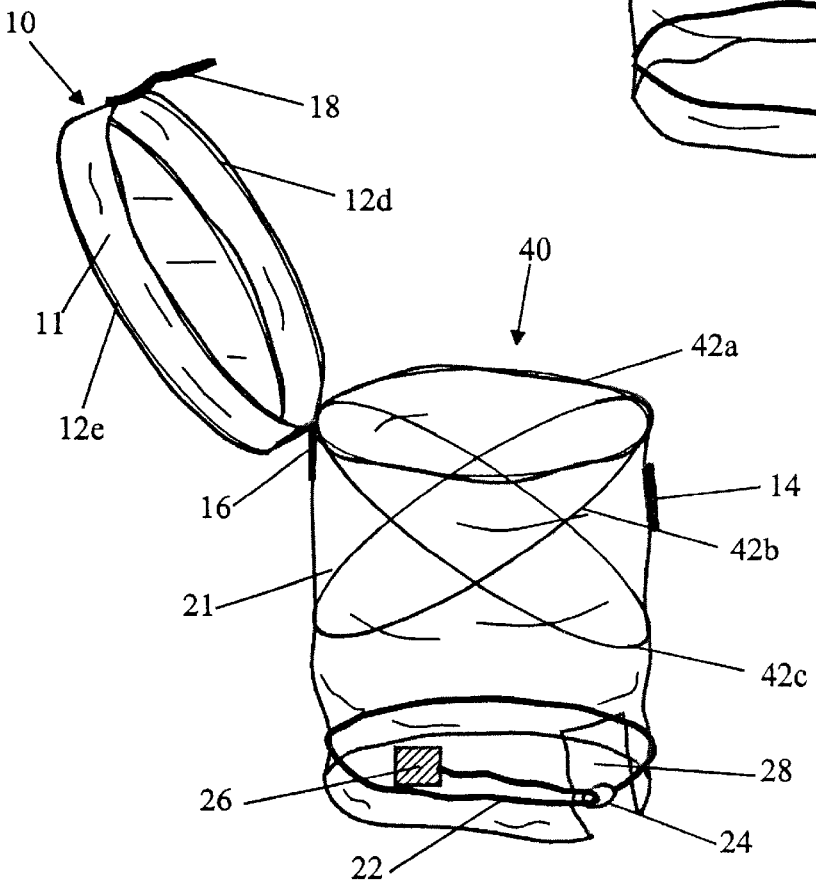
FIGS. 7 & 7A are side illustrations of third and fourth embodiments of the cover.

FIG. 7 shows still another embodiment of the golf bag cover. Cylindrical body 40 and cover 10 are made using methods and materials substantially similar to those used to make cylindrical body 20 and cover 10 of the first embodiment of the golf bag cover with the following exceptions. Spring loops 12*a*, 12*b* and 12*c* are replaced with spring loops 42*a*, 42*b* and 42*c*. Spring loops 42*a*, 42*b* and 42c are made of the same materials and are attached to wall 21 using the same methods used for spring loops 12*a*, 12*b* and 12*c* in the first embodiment description. Spring loop 42*a* is attached around the upper circumference of cylindrical body 40. Spring loop 42*b* and spring loop 42*c* are attached to wall 21 by placing a first edge proximal to spring loop 42*a* and a second edge, located approximately 180 degrees opposite the first edge, at some downward location determined by each spring loop forming an angle of approximately 35 degrees, in one embodiment, from the horizontal plane of spring loop 42*a*. The edges of spring loops 42*b* and 42*c* that are proximal to spring loop 42*a* are located approximately 180 apart on spring loop 42*a*. The diameter of spring loops 42*b* and 42*c* is selected to make them reach the lowest point desired on cylindrical body 40. This angular placement of spring loops 42*b* and 42*c* causes spring loops 42*b* and 42*c* to not only exert an outward force to form the large, hollow space cage inside of cylindrical body 40, but also to exert a downward force on wall 21 to further enhance and define the volume of the hollow space cage in a downward direction. This action is especially useful if wall 21 is made using an extremely light or flexible material. This embodiment of the invention is prepared for stowing, stowed and deployed for use in the same manner as the first embodiment of the invention.

Figure 7A:
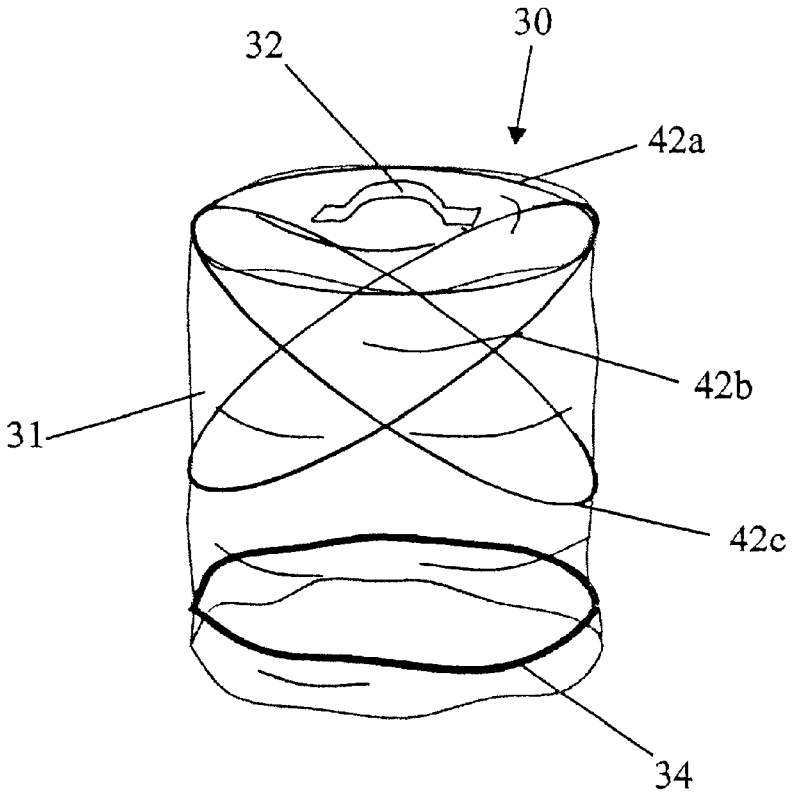

FIG. 7A shows still another embodiment of the golf bag cover using methods and materials substantially similar to those used to make the FIG. 6 embodiment except that spring loops 12*a*, 12*b* and 12*c* are replaced with spring loops 42*a*, 42*b* and 42*c*. Spring loops 12*a*, 12*b* and 12*c* are replaced with spring loops 42*a*, 42*b* and 42*c* in this embodiment in substantially the same way that the spring loops 12*a*, 12*b* and 12*c* were replaced with spring loops 42*a*, 42*b* and 42*c* in the FIG. 7 embodiment, using the same methods and achieving the same results.

The adjustable cord 22 and the elastic cord 34 allow the diameters of cylindrical body 20, cylindrical body 40 and cover 30 to be chosen sufficiently large so as to fit over the open end of most golf bags commonly used. The adjustment of cord 22 or the elastic capability of elastic cord 34 causes the wall material of all the cover embodiments to be snugly contoured to the neck sizes of golf bag openings. The shape of the golf bag opening is also not required to be round since the cover wall material can be snugly contoured to other shaped openings, such as oblong, square, rectangular, etc., and not interfere with the hollow space cage formed by the foldable spring loops which are located above the attachment area. Thus, in a majority of cases, one size of cover will satisfy most golf bag cover needs. This universal size feature along with the simple manufacturing design requirements make the golf bag cover invention very economical to produce and competitive to market.

Each of the three embodiments previously described use multiple foldable spring loops. It will be readily perceived by one schooled in the art that a fewer number or a greater number of foldable spring loops can be utilized depending upon the desired size and location of the hollow space cage, but a minimum of at least one foldable spring loop should be used.

It is apparent from the foregoing that this new and novel golf bag cover provides a good, economical method to safeguard golf clubs when the golfer is unexpectedly caught in inclement weather during a game. It is small in size, so that it can be stowed in a pocket of the golf bag without occupying much space. It is simple, easy and quick to deploy and attach over the open end of the golf bag when needed. It provides clear visibility of all the golf clubs and unobstructed access to the clubs enabling easy removal and replacement as they are used.

While the description contains many specific details, these should not be construed as limitations on the scope of the invention, but rather as an exemplification of the preferred embodiments. Many other variations are possible. For example, the foldable spring loops can be made of a material that is wider than wire. The foldable spring loops can be attached using methods other than glue tape, sewing or heat bonding. The foldable spring loops can be made in shapes other than circular, such as oblong, rectangular, square, etc. The wall of the cover can be made of a colored or opaque material. A great many other wall materials can be used such as vinyl, canvas, paper, or any similar material. Methods other than an adjustable cord or an elastic cord can be used to secure the cover to the golf bag such as Velcro straps, etc. Multiple cutouts can be made in the wall of the cover or the shape of the cutout can be changed to accommodate different shaped or configured golf bag handles. The cutout can utilize an elastic or other stretchable material to help fit around various handle designs. The top can be made completely soft using no foldable spring loops. Elastic or a similar material can be added to the rim of the top to make it fit more snugly. The cover can be built into or made a permanent part of the golf bag. Accordingly, the scope of the invention should be determined not by the embodiments illustrated, but by the appended claims and their legal equivalents.

We claim:

1. A golf bag comprising a body and a cover, the cover comprising: a first elongated hollow body having a first end and a second end, the first elongated hollow body having a wall made of a thin flexible material, the first end and the second end of the first elongated hollow body being open, at least one foldable spring loop perimetrically attached to the wall of the first elongated hollow body, an open space cage internal to the first elongated hollow body formed by the foldable spring loop attachment forcibly expanding the wall in an outwardly direction, the second end of the first elongated hollow body fitting over the open end of the golf bag extending upward past a top of any golf club stored in the golf bag body; a second elongated hollow body having a first end and a second end, the second elongated hollow body having a wall made of the thin flexible material, the first end of the second elongated hollow body being closed using the thin flexible material, the second end of the second elongated hollow body having a dimensional size that fits over the first end of the first elongated hollow body; a hinge means connecting the first elongated hollow body to the second elongated hollow body at a juncture of the first end of the first elongated hollow body and the second end of the second elongated hollow body so that the second elongated hollow body can pivot to open and close the first end of the first elongated hollow body.

2. A golf bag cover according to claim 1 wherein the thin flexible material comprises a plastic.

3. A golf bag cover according to claim 1 wherein the thin flexible material comprises a cloth.

4. A golf bag cover according to claim 1 wherein the foldable spring loop comprises a metal material.

5. A golf bag cover according to claim 1 wherein the foldable spring loop comprises a plastic material.

6. A golf bag cover according to claim 1 wherein the foldable spring loop is deformable by twisting to form at least a pair of combined sections, the combined sections being foldable in layered fashion to form a compact configuration for storage.

7. A golf bag cover according to claim 1 wherein the second end of the first elongated hollow body has at least one cutout notch at the periphery of the second end extending in a generally upwardly direction toward the first end, the notch being dimensionally sized to fit around a uppermost portion of a carrying handle located on a side of the golf bag.

8. A golf bag cover according to claim 1 wherein a latching means is provided between the first end of the first elongated hollow body and the second end of the second elongated hollow body perimetrically located at a position generally 180 degrees opposite the hinge means location so that the second elongated hollow body can be locked to the first elongated hollow body.

9. A golf bag cover according to claim 1 wherein the second elongated hollow body has at least one foldable spring loop perimetrically attached to the wall of the second elongated hollow body.

10. A golf bag cover according to claim 1 wherein at least one foldable spring loop is perimetrically attached to the wall and positioned at an angle to the horizontal plane of the first elongated hollow body and angularly disposed between the first end and the second end of the first elongated hollow body.

11. A golf bag cover according to claim 1 wherein an adjustable fastening means is perimetrically attached to the wall of the first elongated hollow body proximal to a juncture of the second end of the first elongated hollow body and the golf bag so that the first elongated hollow body can be frictionally secured to the golf bag.

12. A golf bag comprising a body and a cover, the cover comprising: an elongated hollow body having a first end and a second end, the elongated hollow body having a wall made of a thin flexible material, the first end of the elongated hollow body being closed using the thin flexible material, the second end of the elongated hollow body being open, at least one foldable spring loop perimetrically attached to the wall of the elongated hollow body, an open space cage internal to the elongated hollow body formed by the foldable spring loop attachment forcibly expanding the wall in an outwardly direction, the second end of the elongated hollow body fitting over the open end of the golf bag extending upward past a top of any golf club stored in the golf bag body, wherein the foldable spring loop is positioned at an angle to the horizontal plane of the elongated hollow body and angularly disposed between the first end and the second end of the elongated hollow body.

* * * * *